US009637364B2

(12) United States Patent
Nussbaum

(10) Patent No.: US 9,637,364 B2
(45) Date of Patent: May 2, 2017

(54) CAR LIFT FOR MOTOR VEHICLES

(75) Inventor: Hans Nussbaum, Kehl-Bodersweier (DE)

(73) Assignee: Otto Nussbaum GmbH & Co. KG, Kehl-Bodersweier (DE)

( * ) Notice: Subject to any disclaimer, the term of this patent is extended or adjusted under 35 U.S.C. 154(b) by 306 days.

(21) Appl. No.: 13/232,320

(22) Filed: Sep. 14, 2011

(65) Prior Publication Data

US 2012/0067672 A1 Mar. 22, 2012

(30) Foreign Application Priority Data

Sep. 14, 2010 (DE) ..... 10 2010 045 287

(51) Int. Cl.
*B66F 7/16* (2006.01)
*B66F 7/20* (2006.01)

(52) U.S. Cl.
CPC ..... *B66F 7/20* (2013.01)

(58) Field of Classification Search
CPC ..... B66F 7/20; F15B 2211/851; F15B 21/042
USPC ..... 187/213, 274, 275, 215; 60/399; 91/401, 91/402
See application file for complete search history.

(56) References Cited

U.S. PATENT DOCUMENTS 3,722,366 A * 3/1973 Richardson ..... 91/170 R
4,573,663 A 3/1986 Nussbaum
4,976,336 A * 12/1990 Curran ..... 187/208
5,110,251 A * 5/1992 Gray ..... B60P 1/4471 187/242
5,299,658 A * 4/1994 Cox et al. ..... 187/209
5,335,499 A * 8/1994 Thompson et al. ..... 60/546
5,573,366 A 11/1996 Meijer
6,050,430 A * 4/2000 Fleagle et al. ..... 212/278
6,279,685 B1 8/2001 Kogan et al.
6,832,806 B2 * 12/2004 Mentink et al. ..... 296/115

FOREIGN PATENT DOCUMENTS

DE 3439292 5/1986
GB 724273 2/1955

* cited by examiner

*Primary Examiner* — William E Dondero
*Assistant Examiner* — Diem Tran
(74) *Attorney, Agent, or Firm* — Volpe and Koenig, P.C.

(57) ABSTRACT

A car lift for motor vehicles, having at least a first and a second lift element, each having at least one hydraulic cylinder/piston assembly (9, 9', 10) for lifting motor vehicles, with each cylinder/piston assembly including an inlet (9*a*, 9*a'*, 10*a*) for feeding and an overflow for draining hydraulic fluid when the motor vehicle is raised. The first cylinder/piston assembly (9, 9') is embodied as the master assembly, by its overflow being connected in a fluid-guiding fashion to the inlet (10*a*) of the second cylinder/piston assembly (10) embodied as a slave assembly. At least one of the cylinder/piston assemblies (9, 9', 10) has an overflow channel (9*c*, 10*c*) arranged and embodied such that only in an area of the end position at maximally raised or maximally lowered vehicles the inlet (9*a*, 9*a'*, 10*a*) of the cylinder/piston assembly is connected in a fluid-conducting fashion to the overflow channel (9*c*, 10*c*).

16 Claims, 8 Drawing Sheets

CAR LIFT FOR MOTOR VEHICLES

CROSS-REFERENCE TO RELATED APPLICATIONS

This application claims the benefit of German Patent Application No. DE 10 2010 045 287.4, filed Sep. 14, 2010, which is incorporated herein by reference as if fully set forth.

BACKGROUND

The invention relates to a car lift for motor vehicles.

In order to lift motor vehicles, particularly for maintenance or repair or for lift systems in parking garages, car lifts are known comprising at least a first and a second lift element, each comprising a hydraulic cylinder/piston assembly for lifting the motor vehicle. In order to lift the motor vehicle, each cylinder/piston assembly is supplied with an inlet for hydraulic fluid, such as hydraulic oil, and the hydraulic fluid displaced by the piston is drained via an overflow. Here, it is known to form the assemblies as a master/slave system. Here, the first cylinder/piston assembly is embodied as a master assembly, by connecting its overflow in a fluid-conducting fashion to the inlet of the second cylinder/piston assembly embodied as a slave assembly.

Such car lifts are known in numerous embodiments. For example, it is known to embody the car lifts as plungers, which are typically arranged underneath the vehicle to be lifted. Additionally, it is known to embody the lift elements as lifting columns, with at least one lifting column being arranged on one side of the vehicle and the second lifting column at the opposite side of the vehicle. Additionally, the embodiment of a car lift is known in the form of a scissor platform, in which the lifting elements are each embodied as lifting scissors. Depending on the weight of the vehicle and the size of the vehicle such car lifts comprise two or more lifting elements.

All above-mentioned embodiments are suitable for the present invention.

The use of at least two cylinder/piston assemblies in a master/slave system is subject to malfunction such that due to thermal expansion and/or air enclosures in the hydraulic system the synchronization between the master and the slave assembly may be disturbed, so that a tilted position of the car lift can develop in parts of the hydraulic system, particularly in the lifted position and/or at pressure peaks.

SUMMARY

The present invention is therefore based on the objective of improving car lifts of prior art, particularly with regards to their susceptibility for leveling the car lift in the extended state and pressure peaks within the hydraulic system, for example due to non-homogenous thermal impingement of the hydraulic system and/or by air enclosures. Another objective comprises simplifying the filling and/or venting of the hydraulic system of the car lift with hydraulic fluid.

These objectives are attained in a car lift according to the invention for motor vehicles. Preferred embodiments of the car lift according to the invention are described in detail below and in the claims.

The car lift for motor vehicles according to the invention comprises at least a first and a second lifting element with at least one hydraulic cylinder/piston assembly each for lifting the motor vehicle. Each cylinder/piston assembly comprises an inlet for feeding and an overflow for draining hydraulic fluid respectively for lifting the motor vehicle. Additionally, the above-mentioned assemblies are embodied as a master/slave system: the first cylinder/piston assembly is embodied as a master assembly, with its overflow being connected in a fluid-conducting fashion to the inlet of the second cylinder/piston assembly embodied as the slave assembly.

It is essential that at least one of the cylinder/piston assemblies comprises an overflow channel. The overflow channel is arranged and embodied such that only in the area of the end position with maximally lifted or maximally lowered vehicles, the inlet of said assembly is connected in a fluid-conducting fashion to the overflow channel.

In conventional cylinder/piston assemblies, at the above-mentioned end position of the piston, no additional hydraulic fluid can be supplied via the inlet. In the car lift according to the invention, however, a fluid-conducting connection to the inlet exists to the overflow channel at the above-mentioned end position, allowing the achievement of considerable advantages: For example, even in the end position hydraulic fluid can still be supplied via the inlet to the assembly, because it can be drained via the overflow channel. This way pressure peaks, particularly so-called pressure spikes, can be avoided. Furthermore, by displacing the assembly into its end position and a further supply of hydraulic fluid and, as mentioned above, draining of the hydraulic fluid via the overflow channel the filling and/or venting of the assembly is easily possible. Furthermore, by a continuous supply of hydraulic fluid via the inlet it can be ensured that the assembly remains in its end position, allowing an easy leveling of the car lift.

The scope of the invention also includes that both an overflow channel of the above-mentioned arrangement and embodiment is provided for the end position, when the vehicle is maximally lifted, as well as an overflow channel for the end position, when the vehicle is maximally lowered. However, it is advantageous to provide only one overflow channel in one of the two end positions. In particular, an overflow channel in the area of the end position of a maximally lifted vehicle is advantageous, because here in this end position a leveling occurs in the lifted state, and thus particularly measurements are possible with higher precision at maximally lifted vehicles due to said leveling.

The scope of the invention also includes that only one of the assemblies of the car lift comprises an overflow channel or that several and particularly all assemblies of the car lift comprise an overflow channel.

Preferably, at least one slave assembly comprises an overflow channel, which is connected in a fluid-conducting fashion to a reservoir for hydraulic fluid and/or to the inlet of another cylinder/piston assembly embodied as a slave assembly.

Therefore, the above-mentioned pressure spikes are avoided:

If based on a maladjustment between the master assembly and the slave, for example by thermal expansion, the slave assembly is already in the end position although the master assembly has not yet reached its end position, in car lifts according to prior art a pressure peak develops during the displacement of the master assembly into the end position in the hydraulic flow path between the overflow of the master assembly and the inlet of the slave assembly. In the above-mentioned preferred embodiment, however, the inlet of the slave assembly is connected in a fluid-conducting fashion to the overflow channel so that the hydraulic fluid can flow via the overflow channel into the above-mentioned reservoir and/or another slave assembly so that no pressure peak develops.

In particular in this preferred embodiment it is ensured that at least the master assembly can always be displaced into an end position.

In another preferred embodiment the master assembly comprises an overflow channel, which is connected in a fluid-conducting fashion to the inlet of the slave assembly. If due to maladjustment between the master assembly and the slave assembly, for example by an above-mentioned thermal expansion, the master assembly is already in the end position although the slave assembly has not reached its end position yet, in car lifts of prior art a known tilted position develops, because the slave assembly cannot be moved into its end position. In the above-mentioned preferred embodiment of the car lift according to the invention, however, in the end position of the master assembly, hydraulic fluid can be supplied, starting at the inlet of the master assembly, via the overflow channel of the master assembly to the inlet of the slave assembly so that even in the above-mentioned maladjustment the slave assembly can be brought into its end position. This way, the above-mentioned tilted position of the car lift is avoided.

In particular it is advantageous for both the master assembly as well as the slave assembly to both comprise an overflow channel, with the overflow channel of the master assembly being connected to the inlet of the slave assembly and the overflow channel of the secondary assembly to the reservoir and/or the inlet of another slave assembly in a fluid-conducting fashion.

This way, on the one hand, all advantages develop mentioned for the respective preferred embodiments. Additionally, in this preferred embodiment a filling and/or venting of the hydraulic system can easily be implemented.

For this purpose, only hydraulic fluid must be supplied via the inlet of the master assembly. As soon as the master assembly has reached its end position hydraulic fluid flows via the overflow channel of the master assembly to the inlet of the slave assembly. As soon as the slave assembly has reached its end position the hydraulic fluid flows via the overflow channel of the slave assembly into the reservoir for hydraulic fluid or another slave assembly. By the continuous influx of hydraulic fluid to the inlet of the master assembly therefore a filling and venting occurs of the master/slave system in a simple fashion.

Preferably the overflow channel of the assembly is connected at least in the above-mentioned end position to the overflow of said assembly in a fluid-conducting fashion. This way, no additional hydraulic lines are required and a cost-effective and error resistant design develops.

Preferably the overflow channel is arranged and embodied such that beginning with a stroke from less than 2 cm from the end position to the end position, the inlet of the assembly is connected to the overflow channel in a fluid-conducting fashion, beneficially beginning at a stroke from than 1 cm from the end position, preferably less than 0.5 cm from the end position. This way it is ensured that during the lifting process essentially a pressure and force distribution is given like in car lifts of prior art having known assemblies and only shortly before reaching the end position hydraulic fluid is drained via the overflow channel.

If the overflow channel is arranged in such a manner that the inlet is connected to the overflow channel in a fluid-conducting fashion when the vehicle is maximally lifted, in general there are no particular requirements to the sizing of the overflow channel and the cylinder and/or piston of the assembly, because in general a so-called "floating position" of the piston is possible in maximally lifted vehicles. However, it is advantageous to embody the current cross-section of the overflow channel smaller by at least a factor of 5 in reference to the cross-section of the piston perpendicular to the lift surface, particularly by at least a factor of 10, preferably by at least a factor of 20.

When the overflow channel is arranged and embodied such that in a maximally lowered vehicle the inlet of the assembly is connected to the overflow channel in a fluid-conducting fashion, upon lifting the vehicle in a low initial stroke range a part of the hydraulic liquid bypasses the piston of the cylinder via the overflow channel into the overflow of the cylinder. This means that pumps and cylinders must be embodied such that the transportation volume of the pump to feed hydraulic fluid into the inlet of the assembly upon lifting the vehicle is greater than the volume flowing through the overflow channel. As soon as the piston has overcome the overflow channel no fluid-conducting connection exists between the inlet and the overflow channel so that the entire volume of the hydraulic fluid supplied via the inlet causes a lifting of the vehicle. An overflow channel arranged in the end position of a maximally lowered vehicle therefore fulfills additionally the objective of a start-up control, i.e. that in case of a continuous transportation volume via the inlet of the assembly first a lower lifting speed is given due to the hydraulic fluid flowing over the overflow channel and subsequently the higher lift speed is achieved without bypassing the piston via the overflow channel.

The overflow channel is preferably embodied without any movable parts, except for the cooperation of the piston of the cylinder. This way, a cost-effective and robust embodiment develops. In particular, the overflow channel is embodied preferably without any interposed valves, particularly without any mechanically operated valves.

A structurally simple and robust design develops in a preferred embodiment, in which the overflow channel is embodied comprising a recess at the inside of the cylinder, with the recess being arranged in a region in which the piston is located in the end position with a maximally lifted vehicle. By this minor measure, such as cutting the above-mentioned recess into the inside of the cylinder, an overflow channel can be realized for a car lift according to the invention. A particularly simple structural design results when the overflow channel comprises a groove at the inside of the cylinder.

Furthermore, a structurally simple design develops in the advantageous embodiment when the overflow channel is embodied at least partially in the area of the cylinder floor of the assembly.

Typical hydraulic cylinders comprise a cylinder head in the area of the end position of the piston. Preferably, the overflow channel of the assembly is embodied in the cylinder head of the cylinder of said assembly, at least partially. This way, furthermore a particularly robust embodiment develops because no separate line paths are necessary to embody the overflow channel. In particular it is advantageous to embody the overflow channel in the cylinder head and to embody the overflow channel such that it mouths in said overflow channel insid3w3e the cylinder head.

Preferably, as described above, the overflow channel comprises a groove at the inside of the cylinder as well as a groove in the floor section of the cylinder head, which preferably opens in the overflow channel. Frequently however, hydraulic cylinders are embodied such that in the end position the piston fails to contact flush at the floor of the cylinder head, because the piston rod projects beyond the piston. In this case the above-mentioned groove in the cylinder floor is not mandatory to embody the overflow channel.

In another advantageous embodiment of the car lift according to the invention the overflow channel of the assembly is embodied as a bypass channel and arranged such that a fluid-conducting connection exists between the inlet and the overflow of the assembly in the end position, without any flowing contact between the hydraulic fluid flowing through the overflow channel and the piston gasket of the piston. This preferred embodiment is based on the knowledge that the risk of damage or at least interference with the sealing effect of the piston gasket of the piston exists when the hydraulic fluid flowing through the overflow channel flows with an abrasive effect past the piston gasket. This is particularly caused in the partially high pressure and flow speed, which has negative effects upon the material of the piston gasket. Therefore it is advantageous for the overflow channel to be embodied in the form of a bypass channel so that the inlet and overflow of the assembly are connected by the bypass channel in a fluid-conducting fashion, however the hydraulic liquid when flowing through the bypass channel is prevented from coming into contact with the piston gasket but bypasses it in a separate channel.

Here, preferably the overflow channel is respectively connected in a fluid-conducting fashion at the end sides each via an opening in the cylinder wall, preferably via a bore, to the cylinder chamber. A particularly simply designed embodiment develops here when two bores are provided in the cylinder wall, spaced from each other in the displacement direction of the piston, which bores are connected to each other in a fluid-conducting fashion, preferably inside the cylinder wall, to form the bypass channel.

As described above, in the car lift according to the invention a displacement into the end position leads to considerable advantages. Preferably the lifting and lowering of the car lift is controlled via a control unit and this in turn is preferably embodied such that at certain intervals, which can be predetermined, or depending on measurements of an exterior temperature sensor and/or pressure sensor a displacement into the end position is suggested to the user if the end position has not been approached within a predetermined time frame and/or after a predetermined exterior temperature and/or exterior pressure difference has been exceeded. This way it is ensured that after a certain period of time, which may lead to maladjustment of the car lift and/or due to a change of exterior conditions, such as ambient temperature and/or ambient pressure, which may lead to maladjustment, the a displacement into the end position is recommended to the user via a display unit so that an automatic leveling can occur.

The car lift according to the invention is particularly suited for the use in the repair and/or maintenance of motor vehicles. Additionally, it can be used advantageously in parking systems, particularly in parking systems in which motor vehicles are parked over top of each other in double or multiple parking systems.

BRIEF DESCRIPTION OF THE DRAWINGS

Additional preferred features and embodiments of the invention are discernible from the following description of exemplary embodiments and the figures; here shown are.

DETAILED DESCRIPTION OF THE PREFERRED EMBODIMENTS

The car lift of the exemplary embodiment shown in the figures is embodied as a lift-column car lift 1, having two lift elements embodied as lift columns 1*a*, and 1*b*. Each lift column comprises support scissors (2*a*, 2*b*) open towards the top and the bottom, which during operation engage the underside of a motor vehicle arranged between the lift columns 1*a*, 1*b* so that it can be lifted by raising the support scissors 2*a* and 2*b*.

The control occurs via a unit 3, which comprises a control panel, not shown, for the operation by a user.

The lift column 1*a* comprises a first hydraulic cylinder/piston assembly to raise or lower the support scissors 2*a* and also comprises the lift column 1*b* of a second cylinder/piston assembly to raise and lower the support scissors 2*b*. The first assembly of the lift column 1*a* is embodied as a master assembly with the overflow of the first assembly being connected in a fluid-conducting fashion via a first overflow line 4 to the inlet of the second assembly embodied as a slave assembly. Both assemblies are embodied such that in the end position of the piston maximally lifted support scissors are given.

It is essential that the two assemblies each comprise an overflow channel, with each overflow channel being connected in a fluid-conducting fashion to the overflow line of the respective assembly and embodied such that only in the area of the end position at a maximally lifted vehicle the inlet of the respective assembly is connected in a fluid-conducting fashion to the respective overflow channel. This is explained in the following based on the hydraulic diagram according to FIG. 2.

Figure 1:
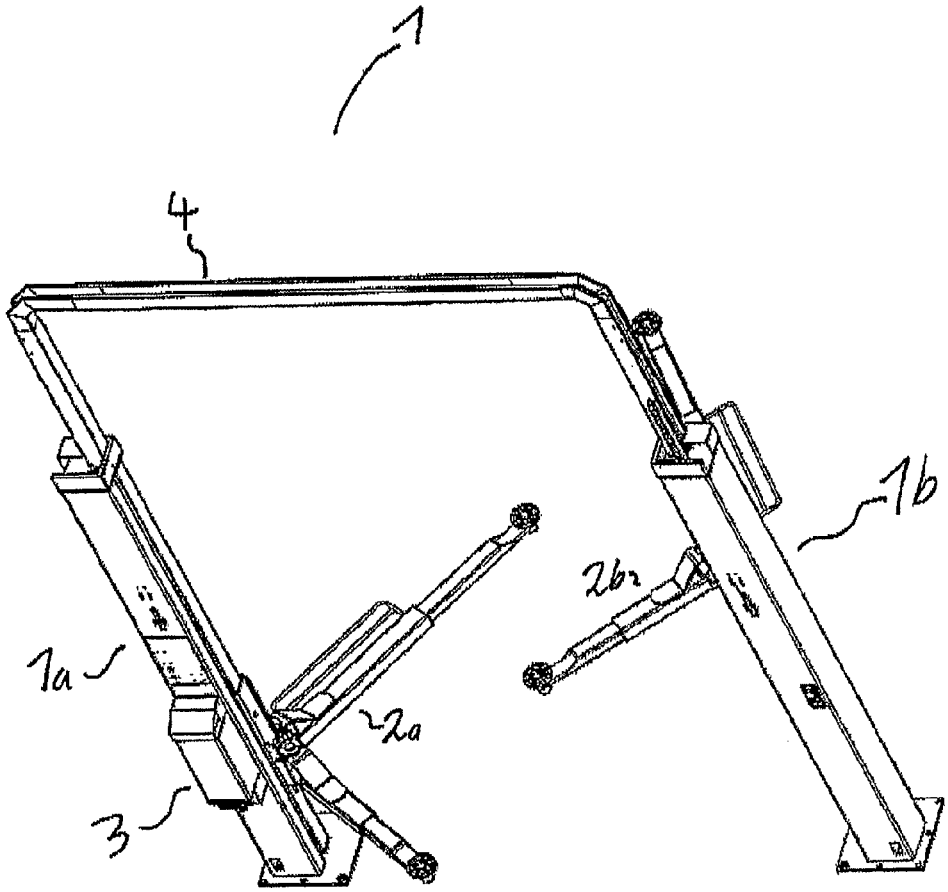
FIG. 1 is a perspective illustration of an exemplary embodiment of a car lift according to the invention.
Figure 2:
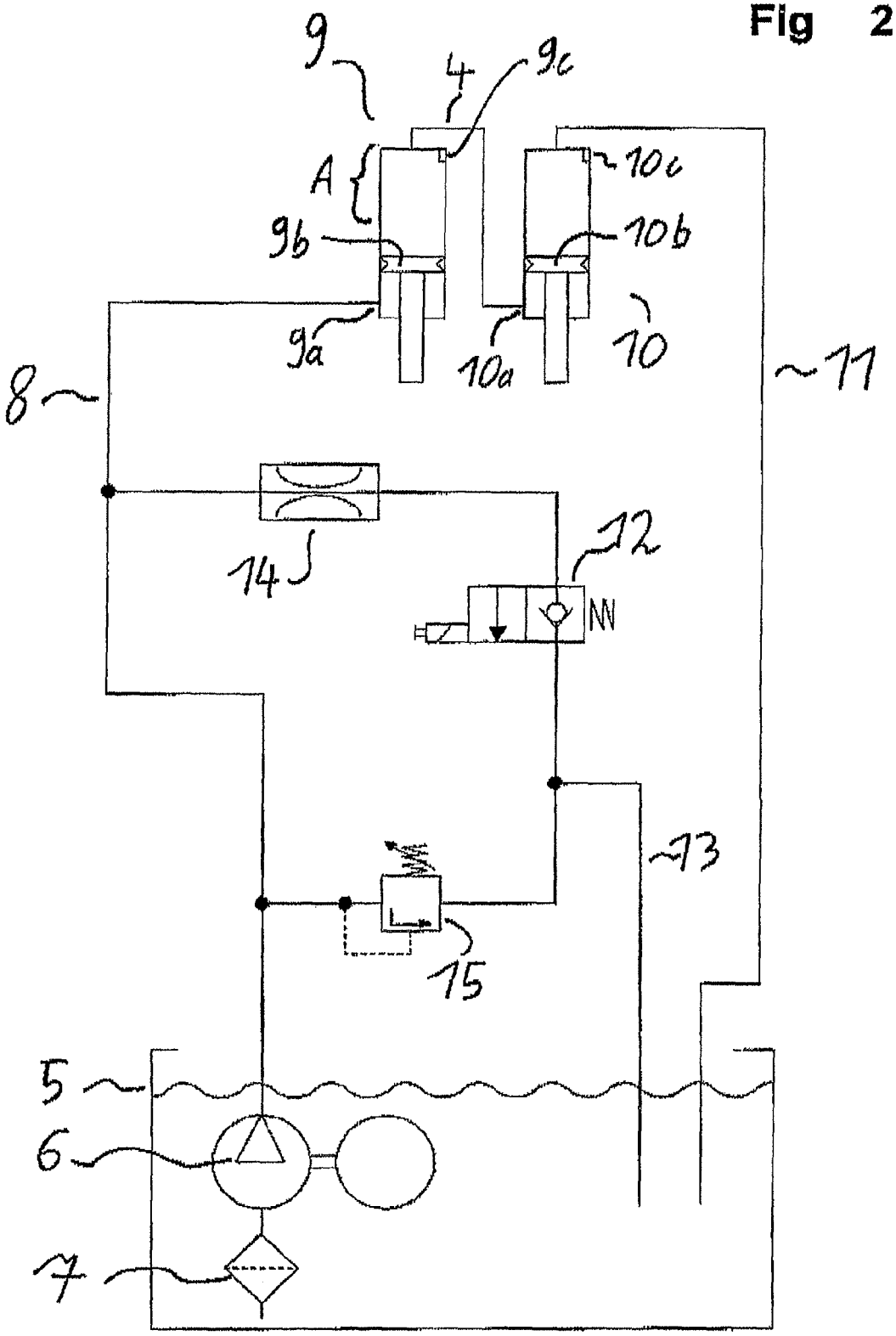
FIG. 2 is a hydraulic diagram of the car lift according to FIG. 1.

FIG. 2 shows a schematic illustration of the hydraulic diagram of the car lift 1 according to FIG. 1. Beginning at a reservoir 5, which is filled with hydraulic oil, for lifting the support scissors hydraulic oil is suctioned using a pump 6 via a suction filter 7 and guided via a first inlet line 8 to the first inlet 9*a* of the first cylinder/piston assembly 9, which is embodied as a master assembly. This way, a displacement of the piston 9*b* of the first assembly 9 occurs upwards in FIG. 2. The hydraulic oil displaced by the assembly 9 above the piston 9*b* is supplied via the first overflow line 4 to an inlet 10*a* of the second cylinder/piston assembly 10 so that the piston 10*b* of the second assembly 10 is also displaced upwards in FIG. 2. The sizing of the two assemblies 9 and 10 is selected such that the pistons 9*b* and 10*b* are raised with the same speed. The hydraulic fluid displaced here by the second cylinder/piston assembly 10 is fed via a second overflow line 11 back to the reservoir 5.

The assemblies 9 and 10 are arranged in the lift columns 1*a* and 1*b* each in the upper area and their pistons are connected to the respective support scissors 2*a* and 2*b* such that any raising of the pistons 9*b* and 10*b* causes a raising of the support scissors 2*a* and 2*b*.

In order to lower the support scissors 2*a* and 2*b* hydraulic oil is fed by switching a 2/2-way valve 12 via a return line 13 to the reservoir 5, and the speed of lowering can be controlled via a lowering brake 14.

For reasons of safety, a line is arranged between the first supply line 8 and the return line 13 having an interposed pressure valve 15.

The first cylinder/piston assembly comprises an overflow channel 9*c* and the second cylinder/piston assembly 10 an overflow channel 10*c*. They are each arranged in the end region of the cylinder, in which the pistons 9*b* and 10*b* are located in maximally raised support scissors 2*a* and 2*b*. The overflow channel 9*c* is connected in a fluid-conducting fashion to the first overflow line 4 and the overflow channel 10*c* is connected in a fluid-conducting fashion to the second overflow line 11.

When the piston 9*b* is located in an end position, the inlet 9*a* is connected in a fluid-conducting fashion via the overflow channel 9*c* to the first overflow line 4. Similarly, the inlet 10*a* is connected in a fluid-conducting fashion via the overflow channel 10*c* to the second overflow line 11 when the piston 10*b* is in the end position.

Here, essential advantages result compared to car lifts of prior art.

On the one hand, the car lift 1 can be filled with hydraulic oil in a simple fashion and vented. For this purpose, it is only necessary to feed with the pump 6 hydraulic oil from the reservoir 5 to the inlet 9*a* of the first assembly 9. As soon as the piston 9*b* has reached its end position hydraulic oil flows via the overflow channel 9*c* and the first overflow line 4 to the inlet 10*a* and thus to the second assembly 10. As soon as the piston 10*b* of the second assembly 10 has reached its end position, hydraulic oil flows via the overflow channel 10*c* and the second overflow line 11 back to the reservoir 5. This way, the hydraulic system is filled in a simple fashion with hydraulic oil and vented.

If due to exterior influences, such as thermal expansion, maladjustment occurs such that the piston 10*b* of the second assembly 10 has reached the end position although the piston 9*b* of the first assembly 9 has not yet reached the end position it still can be brought into the end position by an additional supply of hydraulic oil to the inlet 9*a* of the pistons 9*b*, with the hydraulic oil displaced here being supplied via the first overflow line 4, the inlet 10*a*, the overflow channel 10*c*, and the second overflow line 11 to the reservoir 5 without that here pressure peaks develop, as in the previously mentioned pressure spikes.

If inversely the piston 9*b* of the first assembly 9 is located in the end position although the piston 10*b* of the second assembly 10 has not reached the end position, hydraulic oil can still be supplied via the inlet 9*a*, which is supplied via the overflow channel 9*c* and the first overflow line 4 to the inlet 10*a* of the second assembly so that even the second assembly 10 can be brought into the end position. Regardless of any potential maladjustments, the two pistons 10*b* and 10*a* can therefore be brought into an end position due to the overflow channels 9*c* and 10*c*. This way, leveling into an end position can be ensured, because regardless of the above-mentioned maladjustments a displacement of the two pistons into the end position is ensured.

Therefore, an automatic leveling occurs at each displacement of the piston into its end position, i.e. a maximally lifting of the support scissors 2*a* and 2*b*.

Figure 2A:
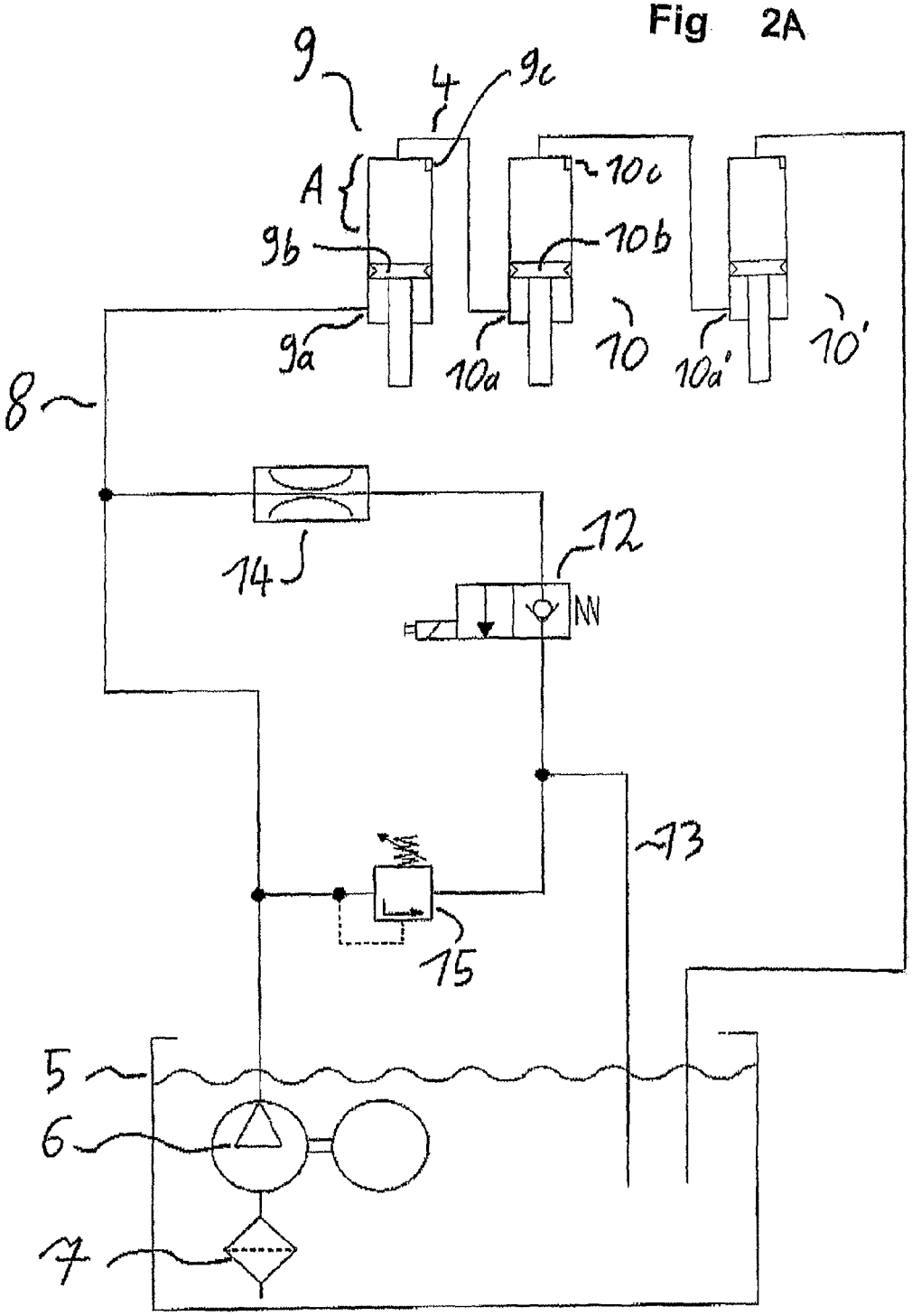
FIG. 2A is a hydraulic diagram similar to FIG. 2 showing another cylinder/piston assembly embodied as a further slave assembly.

FIG. 2A shows the embodiment of FIG. 2 with the slave assembly in the form of the second cylinder/piston assembly 10 including the overflow channel 10*c* being hydraulically connected to the inlet 10*a*' of another cylinder/piston assembly 10' embodied as a further slave assembly.

Figure 3:
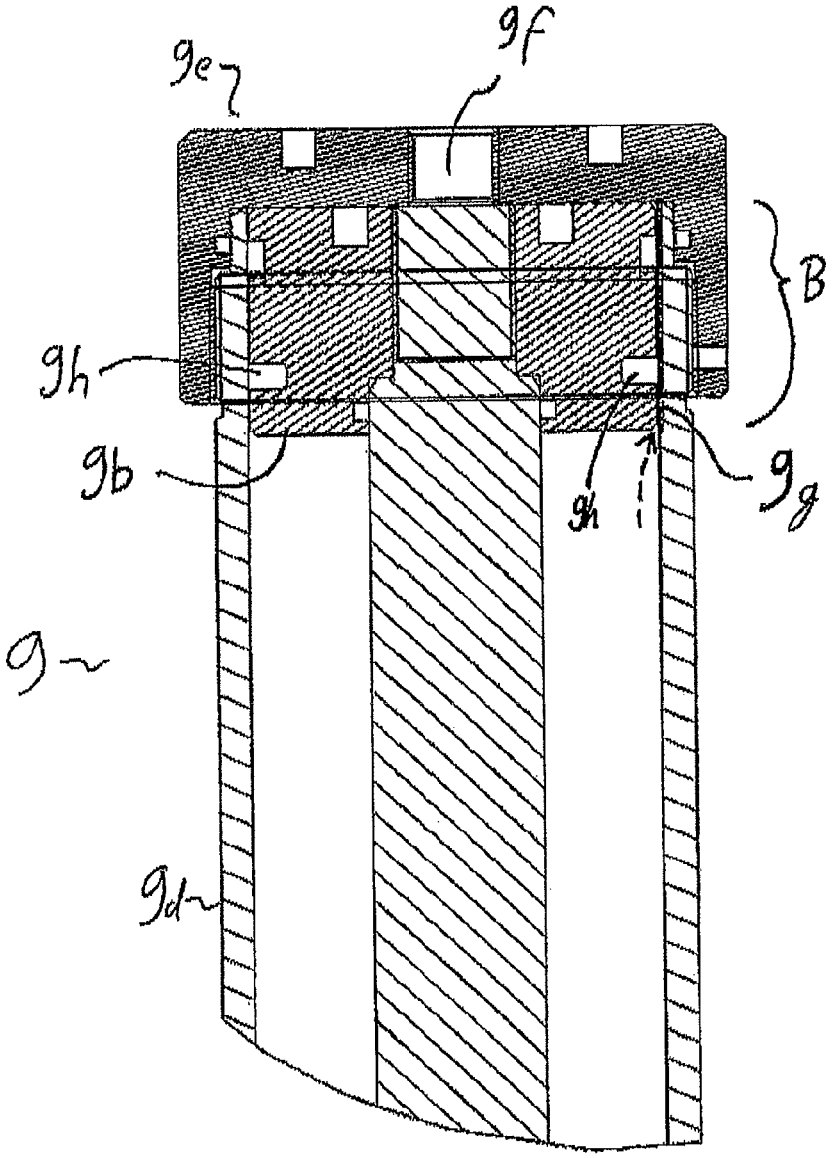
FIG. 3 is an axial cross-section through a cylinder/piston assembly of the car lift according to FIG. 1 as a partial section in an end region when the piston is at its end position.

FIG. 3 shows a section of the cylinder/piston assembly 9 according to drawing A in FIG. 2, with the piston 9*b* being in the end position, different to FIG. 2. FIG. 3 shows a cross-section parallel in reference to the central axis of the piston 9*b* and the cylinder 9*d* of the cylinder/piston assembly 9, with the cross-section extending through the central axis.

The cylinder 9*d* comprises a cylinder head 9*e* in which an overflow connection 9*f* is embodied. This is connected in a fluid-conducting fashion to the first overflow line 4.

It is essential that the cylinder 9*d* comprises an overflow channel 9*c*. This overflow channel 9*c* comprises a groove 9*g*, embodied in the cylinder 9*d* in the area B and extending over a certain stroke path up to approximately the end of the cylinder.

The piston 9*b* comprises a gasket 9*h* embodied as an O-ring, which seals the piston 9*b* from the interior wall of the cylinder 9*d*, except in the end position. In the end position of the piston 9*b* the interior chamber of the cylinder 9*d* is connected to the groove 9*g* in a fluid-guiding fashion according to the dot-dash arrow in FIG. 3. Groove 9*g* opens in a recess (not shown) in the cylinder head 9*e*, which in turn opens in the overflow connection 9*f*.

In the end position of the piston 9*b* according to FIG. 3 therefore a fluid-conducting connection exists of the interior chamber of the cylinder 9*d* via the groove 9*g* to the overflow connection 9*f*, so that the inlet of the assembly 9 is connected in a fluid-conducting fashion to the overflow connection 9*f* and thus to the first overflow line 4. However, when the piston 9*b* is located outside the end position so that the gasket 9*h* fails to contact the entire circumference at the interior wall of the cylinder 9*d*, there is no fluid-conducting connection between the inlet and the overflow of the assembly 9.

Figure 4:
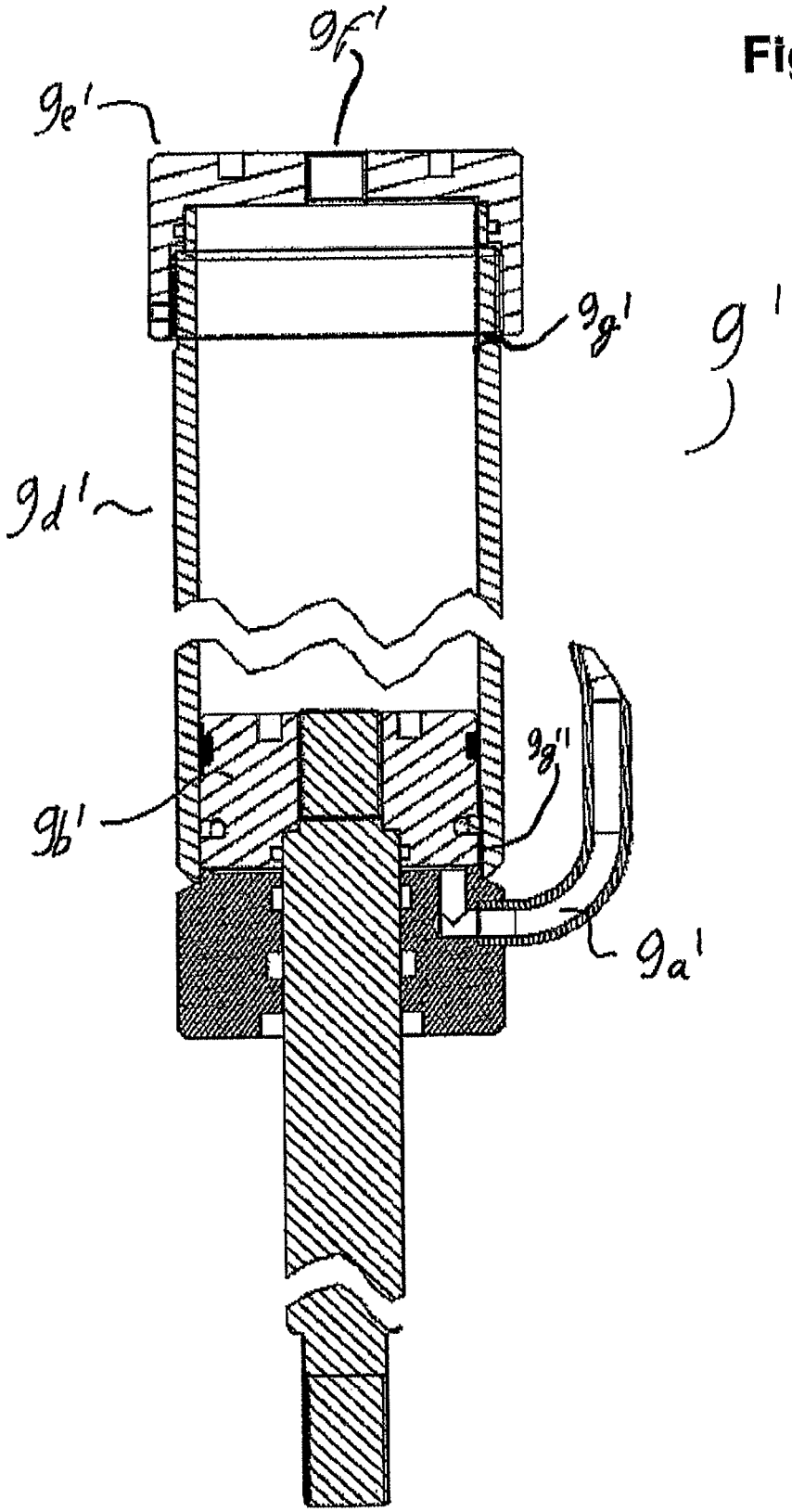
FIG. 4 is an axial cross-section through another exemplary embodiment of a cylinder/piston assembly for a car lift according to FIG. 1, with the partial section of the lower and upper end of the cylinder being shown.

FIG. 4 shows a detail of another exemplary embodiment of a cylinder/piston assembly 9' to be used in a car lift according to FIG. 1. In the selected illustration, the piston 9*b*' is located in the lower end position, i.e. in a maximally lowered vehicle. FIG. 4 also shows an axial section of the cylinder/piston assembly 9'.

The cylinder 9*d*' comprises a cylinder head 9*e*', in which an overflow connection 9*f* is embodied. This is connected to the overflow line 4, when this assembly is used in the car lift according to FIG. 1.

It is essential that the cylinder 9*d*' comprises a first overflow channel 9*c*', which is embodied similar to the overflow channel 9*c* according to FIG. 3 and comprises a similar groove 9*g*', which is embodied at the interior of the cylinder 9*d*'. Additionally, this exemplary embodiment of the cylinder/piston assembly 9' comprises a second overflow channel, which comprises a second groove 9*g*". This groove 9*g*" is also embodied at the inside of the cylinder 9*d*' and extends, at least over the height of the piston 9*b*', in FIG. 4 bottom right, and is arranged such that in the lower end position of the piston 9*b*" an inlet 9*a*' is connected via the groove 9*a*" in a fluid-conducting fashion to the interior chamber of the cylinder 9*d*' positioned above the piston and thus also to the overflow 9*f*. The groove 9*g*" extends, starting at the inlet 9*a*', over the area in which the gasket of the piston is located in the lower end section so that the hydraulic oil, starting at the inlet 9*a*', can flow via the groove 9*g*", i.e. laterally bypassing the gasket.

Therefore, in this preferred exemplary embodiment of the cylinder/piston assembly 9', even in the lower end position of the piston 9*b*', i.e. with a maximally lowered vehicle, for example a filling of the hydraulic system is possible because hydraulic fluid flows past the piston 9*b*', starting at the inlet 9*a*' via the groove 9*g*", and can flow to the overflow 9*f* and thus the hydraulic system can be filled and/or vented. Furthermore it is ensured that upon the formation of the slave assembly according to illustrations in FIG. 4 always a lowering to the end position occurs so that in this case leveling also occurs in the lowered state, and potential maladjustments due to thermal expansion are compensated.

Figure 5:
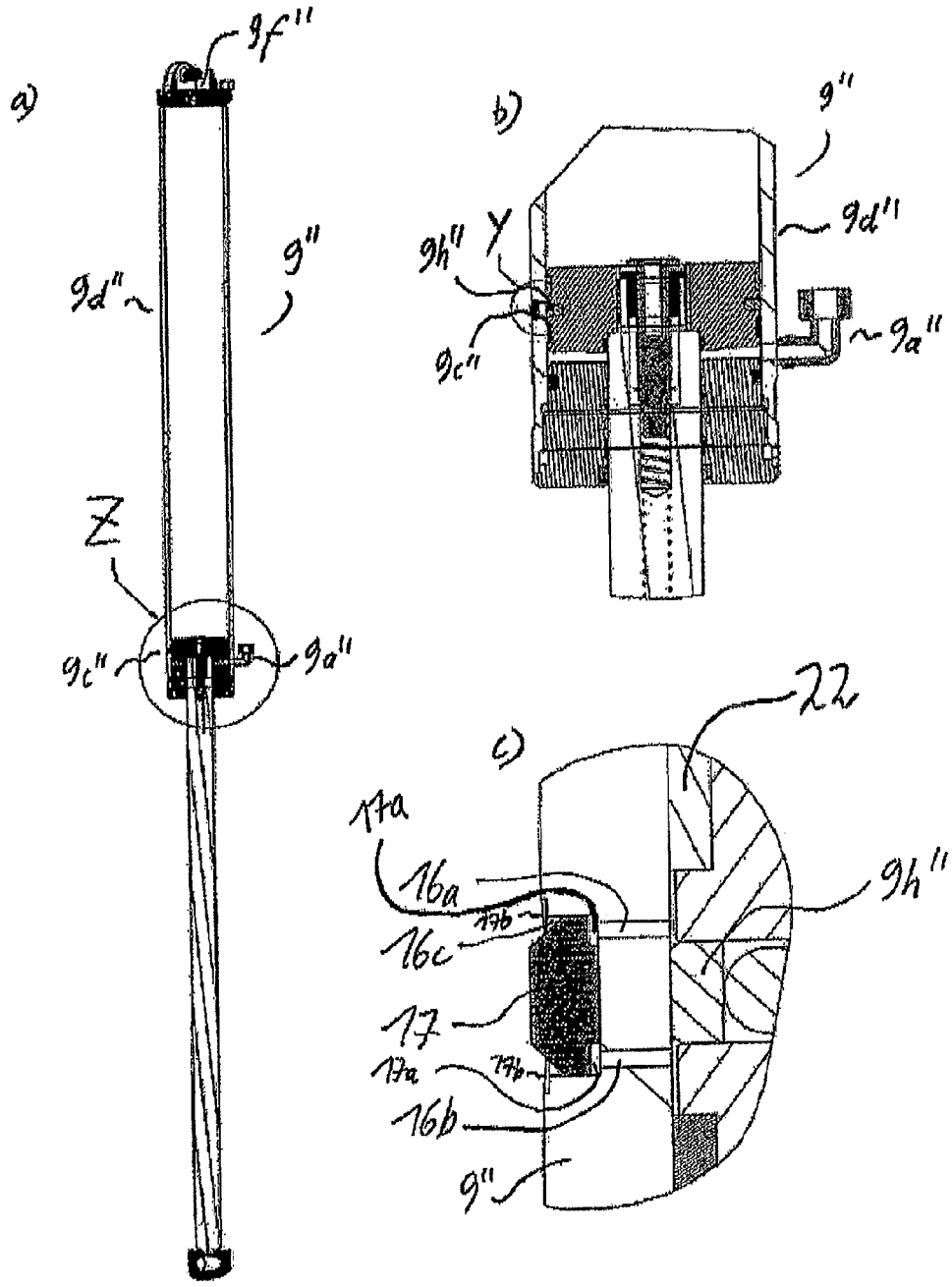
FIGS. 5*a-c* and 6*a-b* are views of another exemplary embodiment of a cylinder/piston assembly for a car lift according to FIG. 1, with the overflow channel being embodied as an overflow channel.
Figure 6:
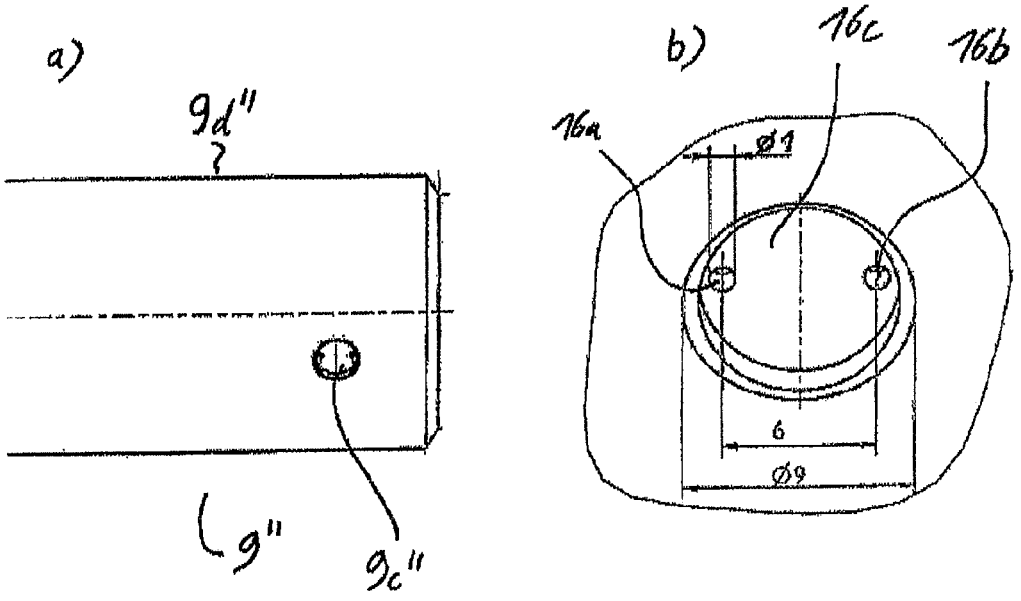

Another exemplary embodiment of a cylinder/piston assembly 9" is shown schematically in FIGS. 5 and 6. Here, the partial illustration 5*a* shows an axial cross-section; the partial illustration 5*b* shows a sectional enlargement of the area Z according to the partial image 5*a*, and the partial image 5*c* in turn a sectional enlargement of the area Y according to the partial image 5*b*.

FIG. 6 shows a partial section of a cylinder 9*d*", with an overflow channel embodied as a bypass channel 9*c*" being embodied in its cylinder wall via several bores. The partial image 6*b* therefore represents an enlargement of the partial image 6*a* in the area of the bypass channel 9*c*".

The assembly 9" is generally designed similar to the assemblies 9 and 9' of FIGS. 3 and 4. An essential difference is given in the embodiment of the overflow channel, which is embodied as a bypass channel 9*c*".

As particularly discernible in FIGS. 5*a* and 5*b*, the bypass channel 9*c*" is arranged such that in the end position for a maximally extended piston, an inlet 9*a*" with an overflow 9*f*" of the assembly 9" is connected in a fluid-conducting fashion. The bypass channel is arranged such that hydraulic fluid flows, bypassing a piston gasket 9*h*", between the inlet 9*a*" and the overflow 9*f*", i.e. without contacting the gasket 9*h*".

For this purpose, a cylinder wall of the cylinder 9*d*" comprises a first bore 16*a* and a second bore 16*b*. The bore 16*a* and 16*b* each open in a third bore 16*c*, which shows a greater diameter compared to the first and second bores.

The third bore 16*c* is embodied via a closing lid 17 in a fluid-tight fashion in reference to the environment. For better visibility, the closing lid 17 is not shown in FIGS. 6*a* and 6*b*.

The closing lid 17 comprises, at its side facing the pistons, an annular recess 17*a*. Therefore, beginning at the opening of the first bore 16*a* into the cylinder chamber there is a fluid-conducting connection via the opening of the first bore 16*a* into the annular recess 17*a* of the closing lid 17. The annular recess 17*a* in turn is connected in a fluid-conducting fashion to the opening of the second bore facing it, which second bore 16*b* in turn opening in the cylinder chamber.

Thus, in the end position shown in FIGS. 5*a, b*, and *c*, hydraulic fluid flows starting at the inlet 9*a*" to the bypass channel 9*c*", i.e. first the first hole 16*b*, subsequently the annular recess 17*a* f the closing lid 17, and then again to the first bore 16*a*, reentering the cylinder chamber, bypassing the piston gasket 9*d*".

The bores 16*a* and 16*b* have approximately a diameter of 1 mm. The bore 16*c* has approximately a diameter of 9 mm. The centers of the bores 16*a* and 16*b* are spaced apart by approximately 6 mm.

The closing lid 17 is arranged via fastening elements 17*b* at a cylinder wall of the cylinder 9*d*".

The assembly 9" therefore has the advantage that during the overflow of the piston gasket 9*h*" via the bypass channel 9*c*" no wear and tear and/or damage of the piston gasket 9*h*" occurs.

A slotted guide ring 22 is arranged vertically above the piston gasket 9*h*", which due to the slot allows a vertical oil flow between the piston and the cylinder wall.

Figure 7:
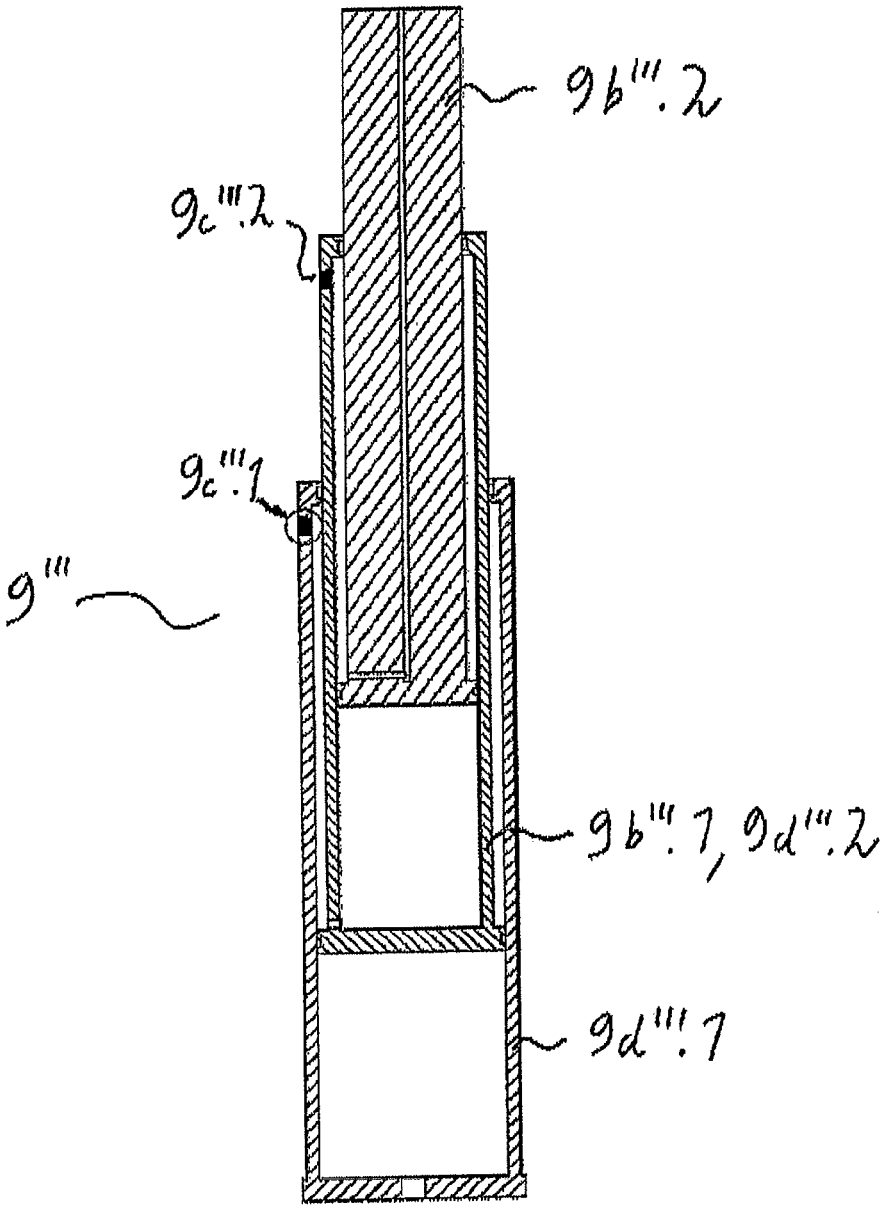
FIG. 7 is a view of another exemplary embodiment of a cylinder/piston assembly for a car lift according to FIG. 1, with the assembly being embodied as a synchronized telescope-cylinder.

FIG. 7 shows another exemplary embodiment of a cylinder/piston assembly 9"', which is embodied as a synchronous telescope/cylinder assembly known per se. The assembly 9"' therefore show two concentrically arranged pistons 9*b*"'.1 and 9*b*"'.2 as well as two concentrically arranged cylinders 9*d*"'.1 and 9*d*"'.2. The piston rod of the piston 9*b*"'.1 therefore forms the cylinder 9*d*"'.2 of the second cylinder/piston assembly.

It is essential that one overflow channel 9*c*"'.1 and 9*e*"'.2 each is embodied in the cylinder wall of the cylinder 9*d*"'.1 and the cylinder 9*d*"'.2.

This way, the advantages of a telescopic cylinder/piston assembly is combined with the above-described advantages by using overflow channels.

The invention claimed is:

1. A car lift for motor vehicles, comprising a first lift element and a second lift element, the first lift element having a first hydraulic cylinder/piston assembly and the second lift element having a second hydraulic cylinder/piston assembly for lifting a motor vehicle, with each of the first hydraulic cylinder/piston assembly and the second hydraulic cylinder/piston assembly comprising a cylinder and a piston with a piston gasket, the cylinder having an inlet connected to an interior chamber at a first side of the piston for feeding hydraulic fluid into the piston when lifting the motor vehicle and a discharge connected to said interior chamber at a second side of the piston for draining hydraulic fluid displaced by said piston when lifting the motor vehicle, and the first hydraulic cylinder/piston assembly being a master assembly, with the discharge thereof being fluidly connected to the inlet of the second hydraulic cylinder/piston assembly which acts as a slave assembly, at least one of the first hydraulic cylinder/piston assembly or the second hydraulic cylinder/piston assembly includes a solid material cylinder wall having a defined material thickness at least in areas of end positions of the piston, said cylinder wall having an inner surface defining an interior chamber of the cylinder, an overflow channel formed by a recess or groove in the inner surface of the cylinder wall positioned at the interior chamber of the cylinder of said at least one of the first hydraulic cylinder/piston assembly or the second hydraulic cylinder/piston assembly, the recess or groove staying within the defined material thickness of the cylinder wall and is arranged such that only in an area of the end positions for the piston that is maximally extended when a vehicle is maximally raised or maximally lowered, the inlet and the discharge of said at least one of the first hydraulic cylinder/piston assembly or the second cylinder/piston assembly with the overflow channel are fluidly connected.

2. A car lift according to claim 1, wherein the overflow channel is arranged such that only in the area of the end position for maximally raised vehicles, the inlet of said at least one of the first hydraulic cylinder/piston assembly or the second hydraulic cylinder/piston assembly is fluidly connected to the overflow channel of a same one of said first hydraulic cylinder/piston assembly or said second hydraulic cylinder/piston assembly with the overflow channel.

3. A car lift according to claim 1, wherein the slave assembly includes the overflow channel, which is hydraulically connected to at least one of a reservoir for hydraulic fluid or to the inlet of another cylinder/piston assembly embodied as a further slave assembly.

4. A car lift according to claim 1, wherein the master assembly includes the overflow channel fluidly connected to the inlet of the slave assembly.

5. A car lift according to claim 1, wherein the overflow channel of the at least one of said first hydraulic cylinder/piston assembly or said second hydraulic cylinder/piston assembly with the overflow channel at least in the end position is hydraulically connected to a reservoir for hydraulic fluid.

6. A car lift according to claim 1, wherein the overflow channel is arranged such that beginning at a stroke of less than 2 cm from an end position up to the end position, the inlet of the at least one of said first hydraulic cylinder/piston assembly or said second cylinder/piston assembly with the overflow channel is hydraulically connected to the overflow channel.

7. A car lift according to claim 6, wherein that the beginning is at a stroke of less than 1 cm from the end position.

8. A car lift according to claim 1, wherein the overflow channel is located in an area of a cylinder floor of the at least one of the first hydraulic cylinder/piston assembly or the second hydraulic cylinder/piston assembly with the overflow channel.

9. A car lift according to claim 1, wherein the overflow channel of the at least one of the first hydraulic cylinder/piston assembly or the second hydraulic cylinder/piston assembly with the overflow channel is provided at least partially in a cylinder head of the cylinder of the at least one of the first hydraulic cylinder/piston assembly or the second hydraulic cylinder/piston assembly with the overflow channel.

10. A car lift according to claim 1, wherein the at least one of the first hydraulic cylinder/piston assembly or the second hydraulic cylinder/piston assembly with the overflow channel is a telescopic cylinder/piston assembly.

11. A car lift according to claim 10, wherein the at least one of the first hydraulic cylinder/piston assembly or the second hydraulic cylinder/piston assembly with the overflow channel is a synchronized telescopic cylinder/piston assembly.

12. A car lift according to claim 10, wherein each of the first hydraulic cylinder/piston assembly and the second hydraulic cylinder-piston assemblies comprises at least one overflow channel.

13. A car lift according to claim 1, wherein the lift elements are lift columns.

14. A car lift for motor vehicles, comprising a first lift element and a second lift element, the first lift element having a first hydraulic cylinder/piston assembly and the second lift element having a second hydraulic cylinder/piston assembly for lifting a motor vehicle, with each of the first hydraulic cylinder/piston assembly and the second hydraulic cylinder/piston assembly comprising a cylinder and a piston with a piston gasket, the cylinder having an inlet connected to an interior chamber at a first side of the piston for feeding hydraulic fluid into the piston when lifting the motor vehicle and a discharge connected to said interior chamber at a second side of the piston for draining hydraulic fluid displaced by said piston when lifting the motor vehicle, and the first hydraulic cylinder/piston assembly being a master assembly, with the discharge thereof being fluidly connected to the inlet of the second hydraulic cylinder/piston assembly which acts as a slave assembly, at least one of the first hydraulic cylinder/piston assembly or the second hydraulic cylinder/piston assembly includes a solid material cylinder wall having a defined material thickness at least in areas of end positions of the piston, said cylinder wall having an inner surface defining an interior chamber of the cylinder, an overflow channel embodied as a bypass channel, which is arranged such that only in an area of an end position for the piston that is maximally extended when the vehicle is maximally raised or maximally lowered, the inlet and the discharge of said at least one of the first hydraulic cylinder/piston assembly or the second cylinder/piston assembly with the overflow channel are fluidly connected such that the hydraulic fluid flowing through the discharge bypasses the piston gasket of the piston, and the bypass channel is formed by first and second bores located within the defined thickness of the cylinder wall that extend to the inner surface of said at least one of the first hydraulic cylinder/piston assembly or the second hydraulic cylinder/piston assembly so that the hydraulic fluid bypasses the piston and flows between the inlet and the discharge through the first and second bores which form the bypass channel, and the first and second bores are fluidly interconnected inside the defined thickness of the cylinder wall of said at least one of the first hydraulic cylinder/piston assembly or the second hydraulic cylinder/piston assembly with the overflow channel.

15. A car lift according to claim 14, wherein the overflow channel is connected at each end side thereof each via an opening in the cylinder wall to a cylinder chamber in a fluid-conducting fashion.

16. A car lift according to claim 14, wherein the first and second bores are hydraulically interconnected inside the cylinder wall of said at least one of the first hydraulic cylinder/piston assembly or the second hydraulic cylinder/piston assembly with the overflow channel by a third bore having a greater diameter than the first and second bores that is closed by a closing lid.

* * * * *